US011715359B1

(12) United States Patent
Schmidt

(10) Patent No.: US 11,715,359 B1
(45) Date of Patent: Aug. 1, 2023

(54) SMOKE WARNING SYSTEM AND SMOKE CLASSIFICATION SYSTEM THEREOF

(71) Applicant: Capped Out Media, Taylorsville, UT (US)

(72) Inventor: Waynard Schmidt, Taylorsville, UT (US)

(73) Assignee: Capped Out Media, Taylorsville, UT (US)

( * ) Notice: Subject to any disclaimer, the term of this patent is extended or adjusted under 35 U.S.C. 154(b) by 2 days.

(21) Appl. No.: 17/712,231

(22) Filed: Apr. 4, 2022

(51) Int. Cl.
*G08B 17/10* (2006.01)
*H01J 49/00* (2006.01)
*G08B 3/00* (2006.01)

(52) U.S. Cl.
CPC ..... *G08B 17/10* (2013.01); *H01J 49/0013* (2013.01); *G08B 3/00* (2013.01)

(58) Field of Classification Search
CPC ..... G08B 17/10; G08B 3/00; H01J 49/0013
See application file for complete search history.

(56) References Cited

U.S. PATENT DOCUMENTS

| | | | | |
|---|---|---|---|---|
| 7,767,959 | B1 * | 8/2010 | Freidhoff | H01J 49/0468 250/288 |
| 9,377,481 | B1 * | 6/2016 | Greenberg | G01N 15/0205 |
| 2018/0053640 | A1 * | 2/2018 | Kurulugama | H01J 49/005 |
| 2021/0076941 | A1 * | 3/2021 | Van Laar | G06N 3/043 |
| 2021/0364467 | A1 * | 11/2021 | DeBord | H01J 49/16 |
| 2022/0238318 | A1 * | 7/2022 | Ishikawa | H01J 49/0031 |

FOREIGN PATENT DOCUMENTS

| | | | | |
|---|---|---|---|---|
| CN | 105009250 | A * | 10/2015 | H01J 49/0013 |
| WO | WO-2008070204 | A2 * | 6/2008 | G01N 27/622 |
| WO | WO-2016039722 | A1 * | 3/2016 | G01N 21/4788 |

* cited by examiner

*Primary Examiner* — Ojiako K Nwugo
(74) *Attorney, Agent, or Firm* — Bochner PLLC; Andrew D. Bochner

(57) ABSTRACT

A smoke alarm may include at least one sensor head including a miniature mass spectrometer; a microcontroller unit configured to receive data from each of the at least one sensor head; and at least one of a photoelectric detector, or ionization detector. Further, the smoke alarm may be capable of determining categories of smoke and delivering discrete alerts accordingly.

16 Claims, 4 Drawing Sheets

SMOKE WARNING SYSTEM AND SMOKE CLASSIFICATION SYSTEM THEREOF

FIELD OF THE DISCLOSURE

The invention is in the field of safety warning apparatuses and systems. Specifically, the invention relates to smoke classification detection, and alarm systems thereof.

INTRODUCTION

Safety is of paramount importance and is an important factor in most aspects of our lives. Notably, fire hazards are a constant concern, with many flammable materials present in our everyday lives. To address this concern, a wide range of measures exist to mitigate the risk of fires occurring. Such measures may include warning systems to notify individuals of potential fires.

Many warning systems may alert an individual upon sensing smoke and/or heat. However, a problem with current warning systems is that they are unable to differentiate between different kinds of smoke, and thus the magnitude of the danger of the budding fire. This results in warning systems being triggered whenever any type of smoke is detected. This problem also prevents warning systems from being able to customize its response to certain types of smoke.

Thus, it would be desirable to have a warning system capable of detecting different kinds of smoke.

It would be yet further desirable to have a warning system capable of customizing its response to detected smoke, based on the type of smoke detected.

SUMMARY

An aspect of the present disclosure may include a smoke alarm. The smoke alarm may include at least one sensor head including a miniature mass spectrometer; a microcontroller unit configured to receive data from each of the at least one sensor head; and at least one of a photoelectric detector, or ionization detector.

In an embodiment, the smoke alarm may further include a cover having an upper portion, and a lower portion. The upper portion may protrude outwardly from a top face of the lower portion.

In another embodiment, the cover may include one or more openings defined by the upper portion of the cover, the one or more openings configured to allow air particulates to travel from an exterior of the cover, to an interior of the smoke alarm. The interior of the smoke alarm may be defined by an interior surface of the cover.

In yet another embodiment, the smoke alarm may further include at least one LED light fixed within an opening in the cover.

In an embodiment, the cover may be constructed from solid molded plastic.

In another embodiment, the smoke alarm may further include a horn module in electrical communication with the microcontroller unit.

In yet another embodiment, the miniature mass spectrometer may be an Aerosol Mass Spectrometer.

In an embodiment, the smoke alarm may further include a user device. The smoke alarm may be in wireless communication with the user device.

In another embodiment, the smoke alarm may further include a power source. The power source may be a 9-volt battery.

An aspect of the present disclosure may include a computer system for classifying and responding to various smoke types comprising one or more processors, one or more computer-readable memories, and one or more computer-readable storage devices, and program instructions stored on at least one of the one or more computer-readable storage devices for execution by at least one of the one or more processors via at least one of the one or more computer-readable memories, the stored program instructions may comprise receiving, via a microcontroller unit, data from a sensor head; determining, from the data, the presence of smoke; if smoke is determined as present, determining, from the data, a smoke type; based on the smoke type, categorizing the smoke type into a smoke category; and based on the smoke category, generating, or not generating, an alert response.

In an embodiment, the alert response may be any one of a Major, Medium, or Minor Alert response. The Major Alert response may include sending location information, via a location sensing device of the smoke alarm, via a network, to emergency response services, sounding, via a horn module, an audible alarm, activating available sprinkler/extinguishing systems, and alerting a user via a user device. The Medium Alert response may include sounding, via the horn module, an audible alarm, and alerting the user via the user device. The Minor Alert response may include alerting the user via the user device.

In another embodiment, the smoke category may be any one of lethal, side stream, food, or nuisance.

In yet another embodiment, if the smoke category is lethal, the system may generate a Major Alert response; if the smoke category is side stream, the system may generate a Medium Alert response; if the smoke category is food, the system may generate a Minor Alert response; and if the smoke category is nuisance, the system may not generate an alert response.

An aspect of the present disclosure may include a computer-readable storage medium having data stored therein representing software executable by a computer, the software having instructions to receive, via a microcontroller unit, data from a sensor head; determine, from the data, the presence of smoke; if smoke is determined as present, determine, from the data, a smoke type; based on the smoke type, categorize the smoke type into a smoke category; and based on the smoke category, generate, or not generate, an alert response.

It is to be understood that both the forgoing and the following descriptions are exemplary and explanatory only and are not intended to limit the claimed disclosure or application thereof in any manner whatsoever.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

Figure 1:
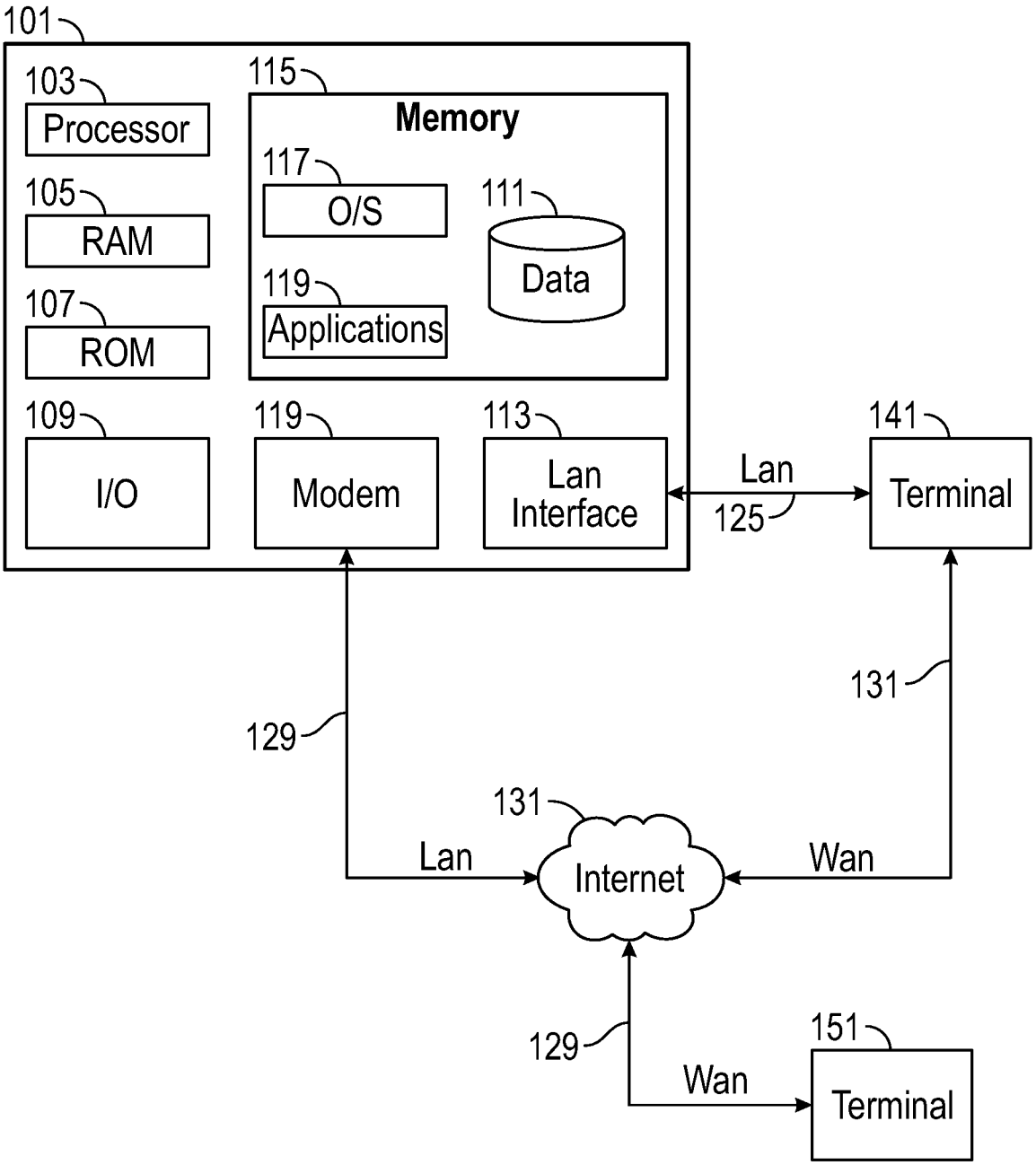
FIG. 1 illustrates a block diagram of a system based on a computer according to aspects of the present disclosure.

For this disclosure, singular words should be construed to include their plural meaning, unless explicitly stated otherwise. Additionally, the term "including" is not limiting. Further, "or" is equivalent to "and/or," unless explicitly stated otherwise. Although, ranges may be stated as preferred, unless stated explicitly, there may exist embodiments that operate outside of preferred ranges.

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

Those skilled in the art will realize that storage devices utilized to provide computer-readable and computer-executable instructions and data can be distributed over a network. For example, a remote computer or storage device may store computer-readable and computer-executable instructions in the form of software applications and data. A local computer may access the remote computer or storage device via the network and download part or all of a software application or data and may execute any computer-executable instructions. Alternatively, the local computer may download pieces of the software or data as needed, or process the software in a distributive manner by executing some of the instructions at the local computer and some at remote computers and/or devices.

Those skilled in the art will also realize that, by utilizing conventional techniques, all or portions of the software's computer-executable instructions may be carried out by a dedicated electronic circuit such as a digital signal processor ("DSP"), programmable logic array ("PLA"), discrete circuits, and the like. The term "electronic apparatus" may include computing devices or consumer electronic devices comprising any software, firmware or the like, or electronic devices or circuits comprising no software, firmware or the like.

The term "firmware" as used herein typically includes and refers to executable instructions, code, data, applications, programs, program modules, or the like maintained in an electronic device such as a ROM. The term "software" as used herein typically includes and refers to computer-executable instructions, code, data, applications, programs, program modules, firmware, and the like maintained in or on any form or type of computer-readable media that is configured for storing computer-executable instructions or the like in a manner that may be accessible to a computing device.

The terms "computer-readable medium", "computer-readable media", and the like as used herein and in the claims are limited to referring strictly to one or more statutory apparatus, article of manufacture, or the like that is not a signal or carrier wave per se. Thus, computer-readable media, as the term is used herein, is intended to be and must be interpreted as statutory subject matter.

The term "computing device" as used herein and in the claims is limited to referring strictly to one or more statutory apparatus, article of manufacture, or the like that is not a signal or carrier wave per se, such as computing device 101 that encompasses client devices, mobile devices, wearable devices, one or more servers, network services such as an Internet services or corporate network services based on one or more computers, and the like, and/or any combination thereof. Thus, a computing device, as the term is used herein, is also intended to be and must be interpreted as statutory subject matter.

FIG. 1 is an illustrative block diagram of system 100 based on a computer 101. The computer 101 may have a processor 103 for controlling the operation of the device and its associated components, and may include RAM 105, ROM 107, input/output module 109, and a memory 115. The processor 103 will also execute all software running on the computer—e.g., the operating system. Other components commonly used for computers such as EEPROM or Flash memory or any other suitable components may also be part of the computer 101.

The memory 115 may be comprised of any suitable permanent storage technology—e.g., a hard drive. The memory 115 stores software including the operating system 117 any application(s) 119 along with any data 111 needed for the operation of the system 100. Alternatively, some or all of computer executable instructions may be embodied in hardware or firmware (not shown). The computer 101 executes the instructions embodied by the software to perform various functions.

Input/output ("I/O") module may include connectivity to a microphone, keyboard, touch screen, and/or stylus through which a user of computer 101 may provide input, and may also include one or more speakers for providing audio output and a video display device for providing textual, audiovisual and/or graphical output.

System 100 may be connected to other systems via a LAN interface 113.

System 100 may operate in a networked environment supporting connections to one or more remote computers, such as terminals 141 and 151. Terminals 141 and 151 may be personal computers or servers that include many or all of the elements described above relative to system 100. The network connections depicted in FIG. 1 include a local area network ("LAN") 125 and a wide area network ("WAN") 129, but may also include other networks. When used in a LAN networking environment, computer 101 is connected to LAN 125 through a LAN interface 113 or adapter. When used in a WAN networking environment, computer 101 may include a modem 127 or other means for establishing communications over WAN 129, such as Internet 131.

It will be appreciated that the network connections shown are illustrative and other means of establishing a communications link between the computers may be used. The existence of any of various well-known protocols such as TCP/IP, Ethernet, FTP, HTTP and the like is presumed, and the system can be operated in a client-server configuration to permit a user to retrieve web pages from a web-based server. Any of various conventional web browsers can be used to display and manipulate data on web pages.

Additionally, application program(s) 119, which may be used by computer 101, may include computer executable instructions for invoking user functionality related to communication, such as email, Short Message Service ("SMS"), and voice input and speech recognition applications.

Computer 101 and/or terminals 141 or 151 may also be devices including various other components, such as a battery, speaker, and antennas (not shown).

Terminal 151 and/or terminal 141 may be portable devices such as a laptop, cell phone, smartphone, smartwatch, or any other suitable device for storing, transmitting and/or transporting relevant information. Terminals 151 and/or terminal 141 may be other devices. These devices may be identical to system 100 or different. The differences may be related to hardware components and/or software components.

Figure 2:
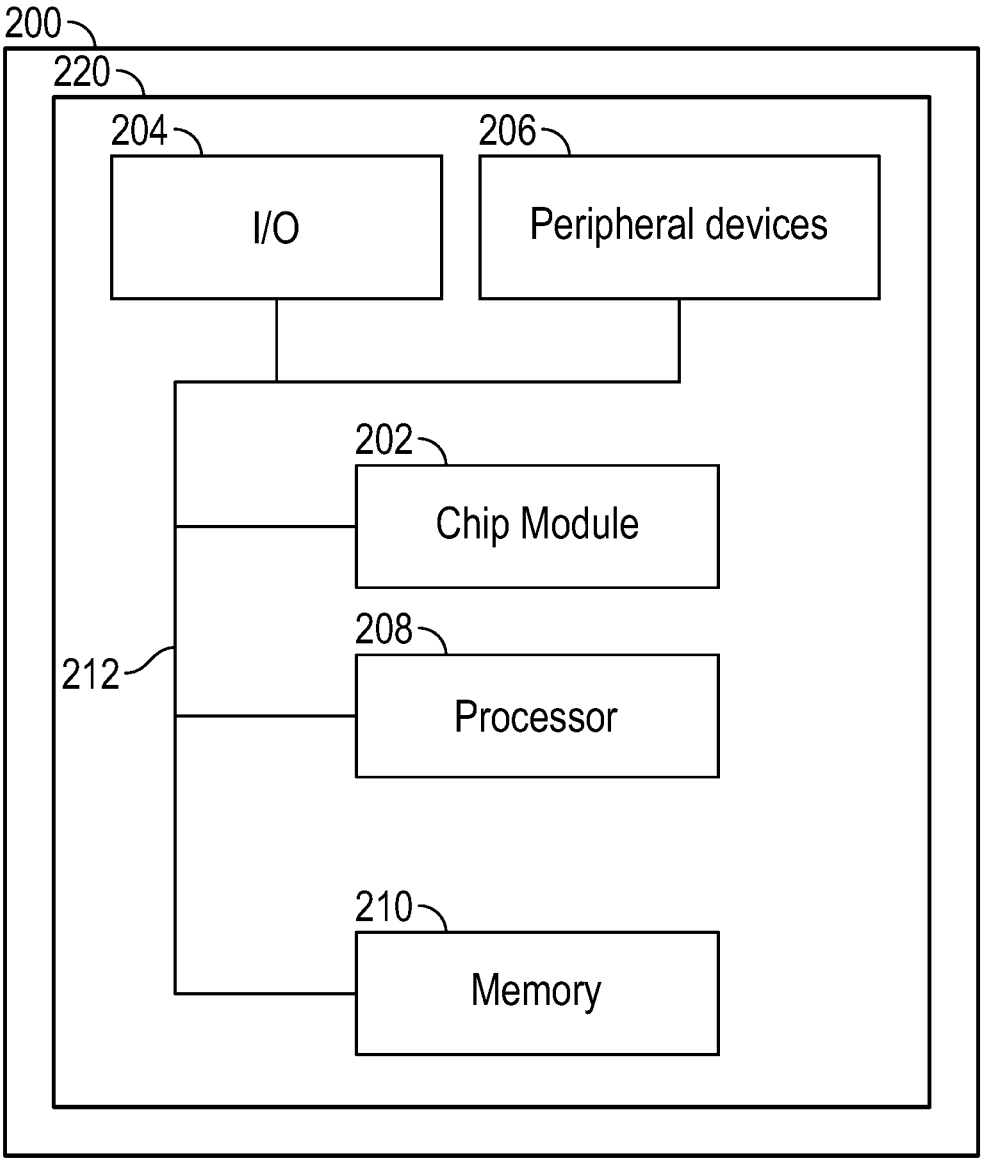
FIG. 2 illustrates a computing machine according to aspects of the present disclosure.

FIG. 2 shows illustrative apparatus 200. Apparatus 200 may be a computing machine. Apparatus 200 may include one or more features of the apparatus shown in FIG. 1. Apparatus 200 may include chip module 202, which may include one or more integrated circuits, and which may include logic configured to perform any other suitable logical operations.

Apparatus 200 may include one or more of the following components: I/O circuitry 204, which may include a transmitter device and a receiver device and may interface with fiber optic cable, coaxial cable, telephone lines, wireless devices, PHY layer hardware, a keypad/display control device or any other suitable encoded media or devices; peripheral devices 206, which may include counter timers, real-time timers, power-on reset generators or any other suitable peripheral devices; logical processing device 208, which may test submitted information for validity, scrape relevant information, aggregate user financial data and/or provide an auth-determination score(s) and machine-readable memory 210.

Machine-readable memory 210 may be configured to store in machine-readable data structures: information pertaining to a user, information pertaining to an account holder and the accounts which he may hold, the current time, information pertaining to historical user account activity and/or any other suitable information or data structures.

Components 202, 204, 206, 208 and 210 may be coupled together by a system bus or other interconnections 212 and may be present on one or more circuit boards such as 220. In some embodiments, the components may be integrated into a single chip. The chip may be silicon-based.

Figure 3:
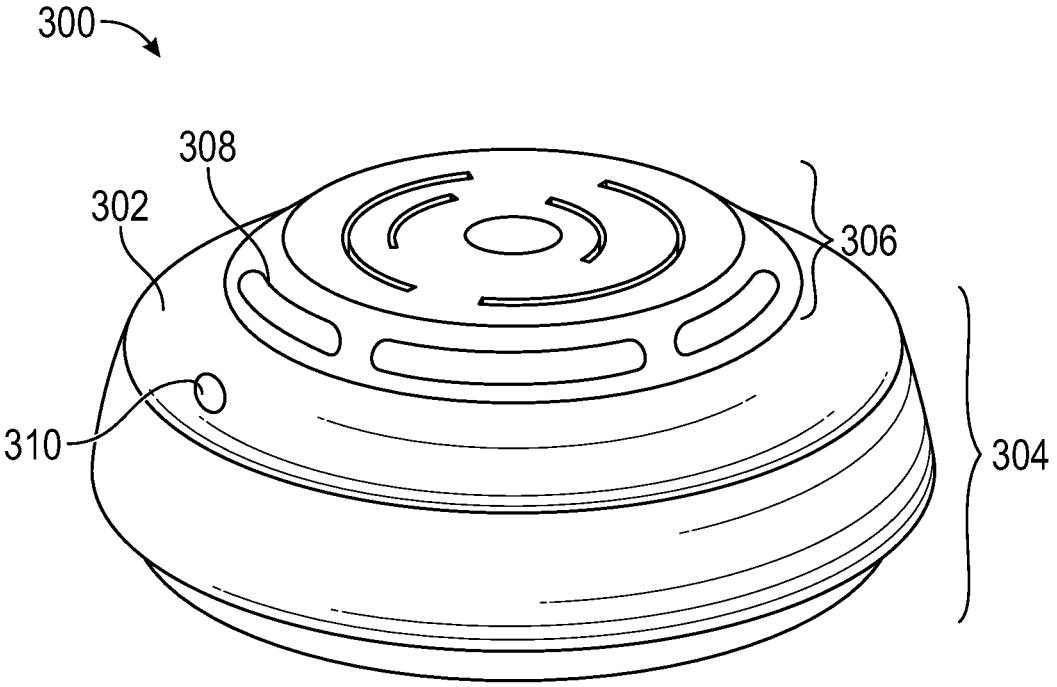
FIG. 3 illustrates a smoke alarm according to various embodiments of the present disclosure.

As illustrated in FIG. 3, aspects of the present disclosure relate to a smoke alarm 300. The smoke alarm 300 may include a cover 302. The cover 302 may be constructed from one or more of rigid plastic, flexible plastic, solid molded plastic, hollow molded plastic, polyester, polyethylene, polyethylene terephthalate, high density polyethylene, low density polyethylene, polystyrene, high impact polystyrene, polyamides, polyvinyl chloride, polypropylene, polycarbonate, polyurethane, polytetrafluroethylene, rubber, silicone, cotton, cardboard, paper, leather, metal, wood, glass, or ceramic. The cover 302 may cover a portion, or entirety, of the interior components of the smoke alarm 300. The cover 302 may include a lower portion 304, and an upper portion 306. The upper portion 306 may protrude outwardly from a top face of the lower portion 304. In an embodiment, the upper portion 306 may be flush with the top face of the lower portion 304. In an alternate embodiment, the cover 302 does not include an upper portion 306. In such an alternate embodiment, the components of the upper portion 306 may exist within the lower portion 304. For example, the one or more openings 308 may be disposed on the lower portion 304.

The cover 302 may include one or more openings 308. The openings 308 may be disposed across various portions of the cover 302. Such portions may be located on the surface of the upper portion 306 as shown in FIG. 3. The openings 308 may allow for air particulates to travel from an exterior of the cover 302, to an interior of the smoke alarm 300. The one or more openings 308 may be sized such that smoke may enter the cover 302, yet debris, such as dust, may not enter the cover 302. The openings 308 may be disposed radially along the cover 302, wherein each of the openings is equidistant from one another.

The smoke alarm 300 may include at least one light 310. The light 310 may be a Light Emitting Diode ("LED"), an incandescent light, a fluorescent light, or any other suitable light. The light 310 may be fixed within an opening in the cover 302 to allow the light 310 to be viewed from an exterior of the smoke alarm 300. The light 310 may indicate a status of the smoke alarm 300, which is discussed in greater detail below.

The smoke alarm 300 may include a sensor head 402, and/or a horn module.

The smoke alarm 300 may receive power from a power source. The power source may be one of an internal, or external power source. In an embodiment, the power source is a 9-volt battery. In another embodiment, the power source is a 120-volt house current. Alternatively, the smoke alarm 300 may include a rechargeable battery and an input configured to transmit electricity to such a rechargeable battery.

The sensor head 402 may include a photoelectric detector. In an embodiment, the photoelectric detector includes a light source, and photodetector. The light source and photodetector may be positioned at approximately 90-degree angles, or any other suitable angles, to one another. The photoelectric detector may be activated when light from the light source hits the photodetector. Such activation may occur when smoke particles are present, which may scatter the light from the light source, causing a portion of the light to hit the photodetector. The photoelectric detector may also be configured to detect the amount of light being scattered, and therefore the density of the smoke. If there is a large scattering effect, then the smoke may be dense. If there is a reduced scattering effect, then the smoke may be light/thin. Accordingly, the memory 210 may include a database comprising information capable of being cross referenced to determine the density of the smoke based on the sensed scattering effect. In further embodiments, the scattering effect geometry or profile may be utilized to determine other characteristics of the smoke.

The sensor head 402 may include an ionization detector. The ionization detector may utilize an ionization chamber and an ionizing radiation source to detect smoke.

The ionizing radiation source may include americium-241. However, any suitable ionizing radiation source may be used. In an embodiment the ionization detector may include 0.9 microcurie of americium-241. However, any suitable amount may be used.

The ionization chamber may include two plates having a voltage charge across them. In such an embodiment, the ionizing radiation source may generate alpha particles, which may ionize the oxygen and nitrogen atoms of the air in the ionization chamber. The resulting negatively charged electrons may be attracted to the plate having a positive charge, while the positively charged atom may be attracted to the plate having a negative charge, which may cause an electrical current to be produced. The presence of smoke may disrupt this current, causing the ionization detector to become activated. Accordingly, the memory 210 may include a database comprising information capable of being cross referenced to determine characteristics of the smoke based on the sensed current disruption.

The sensor head 402 may include a Miniature Mass Spectrometer ("MIMS"). The MMS may be an Aerosol Mass Spectrometer ("AMS"). The MMS may measure the mass-to-charge ratio of ions to be presented as a mass spectrum. As size permits, the MMS may be a miniature mass spectrometer, but may otherwise be a regular mass spectrometer. A mass spectrum may be a type of plot of the ion signal as a function of the mass-to-charge ratio. Accordingly, the memory 210 may include a database comprising information capable of being cross referenced to determine characteristics of the smoke based on the determined mass spectrum of the incident smoke.

Figure 4:
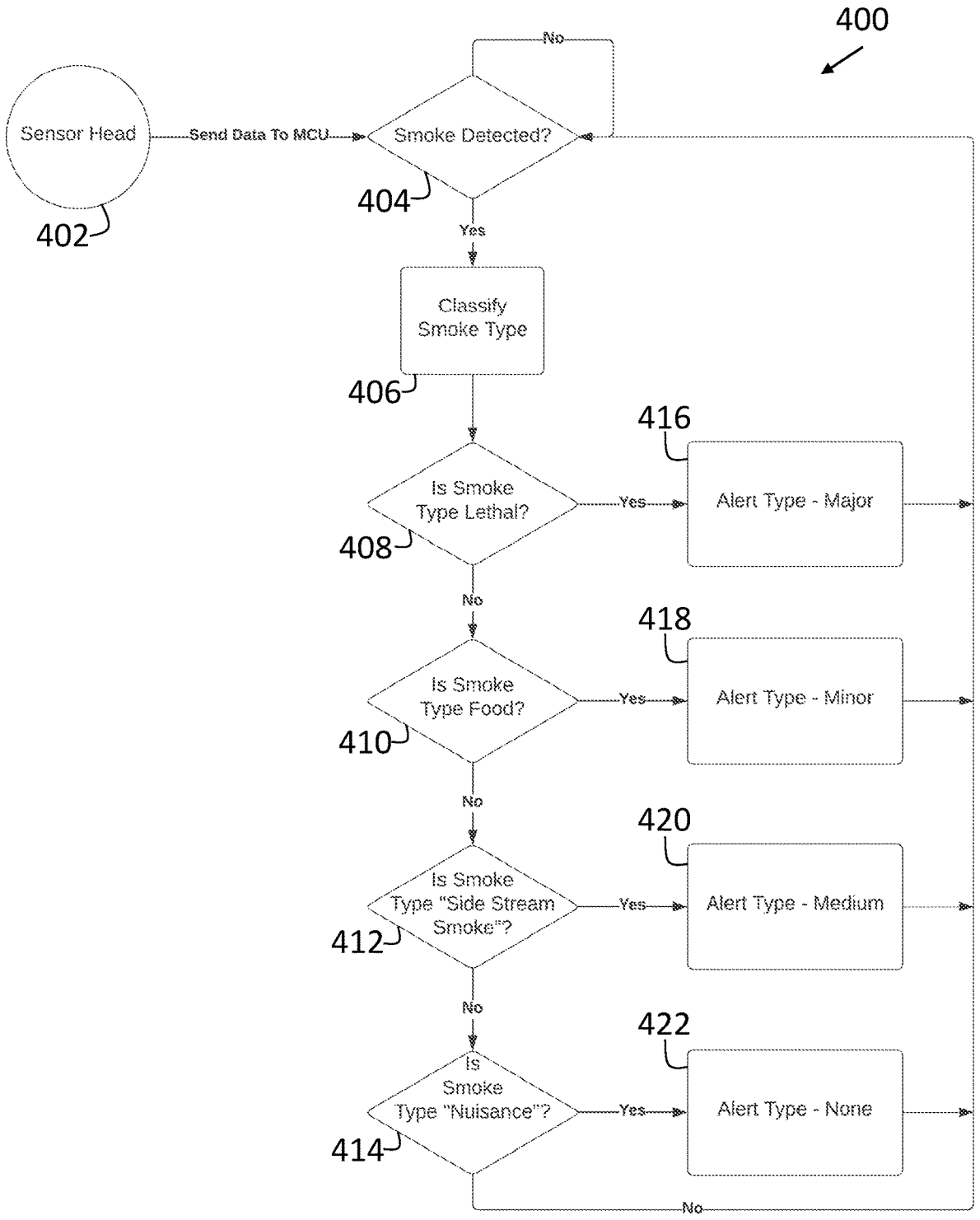
FIG. 4 depicts a workflow of a system for classifying and acting on different smoke types according to aspects of the present disclosure.

Turning to FIG. 4, aspects of the present disclosure may relate to a system for classifying and responding to various smoke types 400 (the "System"). The System 400 may include a sensor head 402, which may include any one or more of a photoelectric detector, ionization detector, or MMS. However, the sensor head may include any other suitable apparatus for detecting smoke and/or smoke characteristics. Data from the sensor head 402 (the "Data") may be sent to a Microcontroller Unit ("MCU"). The MCU may contain computer-executable instructions for processing the data received from the sensor head 402.

In an embodiment, there is more than one sensor head 402. Each sensor head 402 may communicate with the MCU via a wireless, or wired, connection. Having more than one sensor head 402 communicating wirelessly with the MCU permits a user to easily place sensor heads 402 in areas which are at a high risk of catching fire, or generating certain smoke types. For example, a user may choose to place a sensor head 402 in each of a kitchen, bedroom, and living room. Each sensor head 402 may be assigned a unique location tag stored on a database. This may allow the location of an "activated" sensor head 402 to be determined. The same location tagging may be utilized for multiple smoke alarms 300 placed at different locations.

At 404, the MCU may constantly monitor the Data. Alternatively, the MCU may monitor the Data at spaced intervals. The MCU may monitor the Data for an "activated" reading from the photoelectric, or ionization detector to determine the presence of smoke. For example, the sensor head 402 may transmit Data to the MCU only upon an event, wherein the event is, for example, a disruption in current, atypical mass spectrum, or light scattering. Thus, the System may decrease power usage and or processing burdens by evaluating signals from the sensor head 402 only upon occurrence of an event.

Once smoke is detected, the System 400 may classify the smoke type at 406. The MCU may analyze the Data received from the MMS and/or the photoelectric detector to determine the smoke type.

Each smoke type may be categorized into smoke categories. Such smoke categories may include lethal, food, side stream, or nuisance. However, the System 400 may be capable of sorting smoke into any suitable categories. Further, the System 400 may be adapted to categorize an incident smoke into more than one of the smoke categories. The System 400 may execute an alert response based on the smoke category detected.

At 408, if the detected smoke falls into the "lethal" category, the system may generate a "Major Alert" 416. Smoke that falls into the "lethal" category may include lethal or toxic smoke; such smokes may include substances such as carbon monoxide, hydrogen cyanide, hydrochloric acid, hydrobromic acid, hydrogen fluoride, phosgene, or other life-threatening substances known to those skilled in the art. Such smoke triggering the Major Alert 416 may emanate from a fire that poses significant risk to the property or its inhabitants.

The Major Alert 416, Medium Alert 420, and Minor Alert 418 may include a series of actions to be taken by the System 400.

The Major Alert 416 may include sending location information of the smoke alarm 300 via a network to emergency response services, sounding an audible alarm, activating available sprinkler/extinguishing systems, or alerting a user via a user device. Alerting a user via a user device is discussed in further detail below.

Turning to 410, the System 400 may generate a "Minor Alert" 418 if the detected smoke falls into the "food" category. Smoke that falls into the "food" category may include non-lethal and non-health endangering smoke, such smokes may include substances such as carbon dioxide, or other non-lethal and non-health endangering substances known to those skilled in the art. Accordingly, the source of such "food" smoke may be small kitchen fires or burning food emanating from an oven.

The Minor Alert 418 may include alerting a user via a user device.

At 412, if the detected smoke falls into the "side stream" category, the system may generate a "Medium Alert" 420. Smoke that falls into the "side stream" category may include non-lethal but health-endangering smoke, such smokes may include substances such as nicotine, tetrahydrocannabinol, formaldehyde, or other health-endangering substances known to those skilled in the art. For example, side stream smoke may include smoke resulting from tobacco products, such as cigarettes or cigars.

The Medium Alert 420 may include sounding an audible alarm, or alerting a user via a user device.

The System 400 may alternate between alert types depending on the data being received from the sensor head 402. As a non-limiting example, the system 400, while performing a Medium Alert 420 response, may receive data from the sensor head 402 indicating the presence of carbon monoxide in the detected smoke, after which the system 400 may move to perform a Major Alert 416 response.

The density of the smoke may also dictate which category the detected smoke falls into. For example, highly dense smoke may cause otherwise "food" smoke to be categorized as "lethal," generating a Major Alert 416 response.

Thus, the incident smoke may be analyzed to determine a smoke profile. The smoke profile may include characteristics of the incident smoke. For example, the smoke profile may include the density of the incident smoke, the chemical composition of the incident smoke, the duration of the incident smoke, the estimated volume of the incident smoke, the temperature of the incident smoke, the rate of entry to the alarm 300 of the incident smoke, or any other pertinent characteristics. Similarly, the memory 115 and/or memory 210 may include a smoke profile companion database including the smoke profiles of various types of model smoke profiles. In an embodiment, each of the model smoke profiles may be compared to the smoke profile of the incident smoke to determine the potential danger level, corresponding smoke type 408-414, and/or resulting alert type 416-422. In another embodiment, each of the smoke types may include characteristic thresholds, such that once the incident smoke surpasses the characteristics thresholds the incident smoke is determined to have such a characteristics.

Each alert response may last for a predetermined amount of time, before the system 400 returns to a monitoring state. In another embodiment, the alert response may last until the photoelectric, or ionization detector returns a "deactivated" reading indicating that there is no longer smoke present. The alert response may be manually shut off via a physical button, digital button, or other suitable user interface. The temporal duration required to "deactivate" a reading may be a function of the determined smoke type 408-414. For example, a Medium Alert 420 may be deactivated 30 seconds after the sensor head 402 reads a monitoring state once again; yet, a Major Alert 416 may be deactivated 2 minutes after the sensor head 402 reads a monitoring state once again. In effect, by prolonging the alert of more dangerous smoke types, the smoke alarm 300 may more cautiously protect the inhabitant.

The System 400 may communicate with a user device. The user device may be an apparatus 200, or any suitable device known to those skilled in the art. In such an embodiment, the system 400 may communicate certain information to the apparatus 200 such as alert level, detected substances, and a location of the activated smoke alarm. The location of each smoke alarm may be stored in a database, or may be determined by a location sensing device such as a Global Positioning System ("GPS") device. The apparatus 200 may be capable of receiving data from multiple smoke alarms 300.

The apparatus 200, may display the information received from the System 400 via a display of the apparatus 200. A user may interact with the display via touch, and may carry out certain functions such as silencing the alarm, initiating a call to emergency response services, or activating fire-extinguishing systems.

At 414, the System 400 may generate no response 422 if the detected smoke falls into the "nuisance" category. Instead, the System 400 may return to a monitoring state. The monitoring state may comprise a false-positive threshold configured to enable minor fluctuations in the incident smoke profile.

The System 400 may communicate with external warning systems, and may be programmed to engage such external warning system(s) depending on the Alert level. For example, the System 400 may be in communication with a lighting system. In such an example, the System 400 may cause a strobing effect, or change in light color to alert a user of a detection of smoke falling into one of the aforementioned smoke categories.

In a further embodiment, the System 400 is in communication with the client device and/or a server, such that incident smoke characteristics, alert levels, smoke types, time of alerts, location of the alerting smoke detector, and other pertinent information is stored on the client device and/or the server. Accordingly, such information transmitted to the client device and/or server may be reviewed after a house fire. For example, an arson investigator or fire investigator may analyze the information stored on the client device and/or server to determine the source of the fire.

Finally, while certain novel features of the present invention have been shown and described, it will be understood that various omissions, substitutions and changes in the forms and details of the device illustrated and in its operation can be made by those skilled in the art without departing from the spirit of the invention.

What is claimed is:

1. A smoke alarm, comprising:

at least one sensor head including a miniature mass spectrometer;

a microcontroller unit configured to receive data from each of the at least one sensor head; and at least one of a photoelectric detector, or ionization detector.

2. The smoke alarm of claim 1, further including a cover having an upper portion, and a lower portion.

3. The smoke alarm of claim 2, wherein the upper portion protrudes outwardly from a top face of the lower portion.

4. The smoke alarm of claim 2, wherein the cover includes:

one or more openings defined by the upper portion of the cover, the one or more openings configured to allow air particulates to travel from an exterior of the cover, to an interior of the smoke alarm, wherein the interior of the smoke alarm is defined by an interior surface of the cover.

5. The smoke alarm of claim 2, further including at least one LED light fixed within an opening in the cover.

6. The smoke alarm of claim 2, wherein the cover is constructed from solid molded plastic.

7. The smoke alarm of claim 1, further including a horn module in electrical communication with the microcontroller unit.

8. The smoke alarm of claim 1, wherein the miniature mass spectrometer is an Aerosol Mass Spectrometer.

9. The smoke alarm of claim 1, further including a user device, wherein.

10. The smoke alarm of claim 1, further including a power source, and wherein the power source is a 9-volt battery.

11. A computer system for classifying and responding to various smoke types comprising one or more processors, one or more computer-readable memories, and one or more computer-readable storage devices, and program instructions stored on at least one of the one or more computer-readable storage devices for execution by at least one of the one or more processors via at least one of the one or more computer-readable memories, the stored program instructions comprising:

receiving, via a microcontroller unit, data from a sensor head;

determining, from the data, a presence of smoke;

if smoke is determined as present, determining, from the data, a smoke type;

based on the smoke type, categorizing the smoke type into a smoke category; and based on the smoke category, generating, or not generating, an alert response.

12. The system on claim 11, wherein the alert response is any one of a Major, Medium, or Minor Alert response.

13. The system of claim 12, wherein:

the Major Alert response includes sending location information, via a location sensing device of a smoke alarm, via a network, to emergency response services, sounding, via a horn module, an audible alarm, activating available sprinkler/extinguishing systems, and alerting a user via a user device;

the Medium Alert response includes sounding, via the horn module, an audible alarm, and alerting the user via the user device; and the Minor Alert response includes alerting the user via the user device.

14. The system of claim 13, wherein the smoke category is any one of lethal, side stream, food, or nuisance.

15. The system of claim 14, wherein:

if the smoke category is lethal, the system generates a Major Alert response;

if the smoke category is side stream, the system generates a Medium Alert response;

if the smoke category is food, the system generates a Minor Alert response; and if the smoke category is nuisance, the system does not generate an alert response.

16. A non-transitory computer-readable storage medium having data stored therein representing software executable by a computer, the software having instructions to: receive, via a microcontroller unit, data from a sensor head; determine, from the data, a presence of smoke; if smoke is determined as present, determine, from the data, a smoke type; based on the smoke type, categorize the smoke type into a smoke category; and based on the smoke category, generate, or not generate, an alert response.

* * * * *